US006786242B2

(12) United States Patent
Salway et al.

(10) Patent No.: US 6,786,242 B2
(45) Date of Patent: Sep. 7, 2004

(54) METHOD FOR MAKING A TEXTILE

(75) Inventors: Douglas John Salway, Moore, SC (US); Jan L. Williams, Greenville, SC (US); Daniel P. Gillig, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/739,481

(22) Filed: Dec. 18, 2003

(65) Prior Publication Data

US 2004/0129334 A1 Jul. 8, 2004

Related U.S. Application Data

(63) Continuation of application No. 10/365,594, filed on Feb. 12, 2003, now Pat. No. 6,684,911, which is a continuation of application No. 10/050,025, filed on Jan. 15, 2002, now abandoned.

(51) Int. Cl.[7] ..... D03D 11/00

(52) U.S. Cl. ..... 139/383 A; 139/408; 139/411; 139/426 R; 162/900

(58) Field of Search ..... 139/383 A, 411, 139/408, 426 R; 162/900, 901, 902

(56) References Cited

U.S. PATENT DOCUMENTS

| | | | | |
|---|---|---|---|---|
| 2,115,658 | A | 1/1938 | Whittier | 139/420 D |
| 2,157,082 | A | 5/1939 | Mines | 139/411 |
| 2,167,542 | A | 7/1939 | Barrell | 139/410 |
| 2,180,054 | A | 11/1939 | Hindle | 139/408 |
| 2,208,090 | A | 7/1940 | Whittier | 139/411 |
| 2,540,874 | A | 2/1951 | Geddings | 139/411 |
| 2,797,713 | A | 7/1957 | Hoffacker | 139/411 |
| 2,817,371 | A | 12/1957 | Bussiere | 139/383 |
| 2,934,097 | A | 4/1960 | Hindle | 139/383 A |
| 2,949,134 | A | 8/1960 | Hindle | 139/426 R |
| 5,085,252 | A | 2/1992 | Mohamed et al. | 139/11 |
| 5,458,693 | A | 10/1995 | Codorniu | 139/383 A |
| 5,465,760 | A | 11/1995 | Mohamed et al. | 139/11 |

*Primary Examiner*—John J. Calvert
*Assistant Examiner*—Robert H Muromoto, Jr.
(74) *Attorney, Agent, or Firm*—Terry T. Moyer; Jeffery E. Bacon

(57) ABSTRACT

A textile with first grouping of yarns separated from a second grouping of yarns, and displacement yarns disposed between the first grouping of yarns and the second grouping of yarns such that the displacement yarns progress in a sinusoidal manner to alternately contact the adjacent displacement yarn.

17 Claims, 6 Drawing Sheets

FIG. –1–

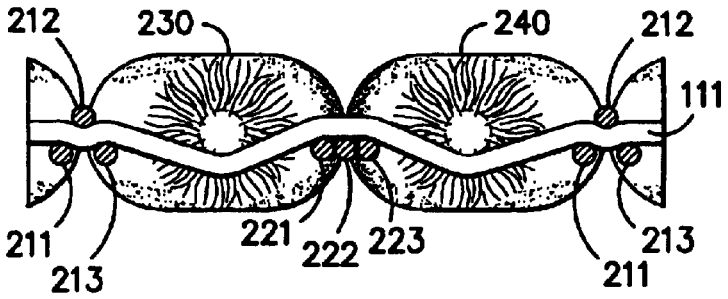
FIG. —4A—
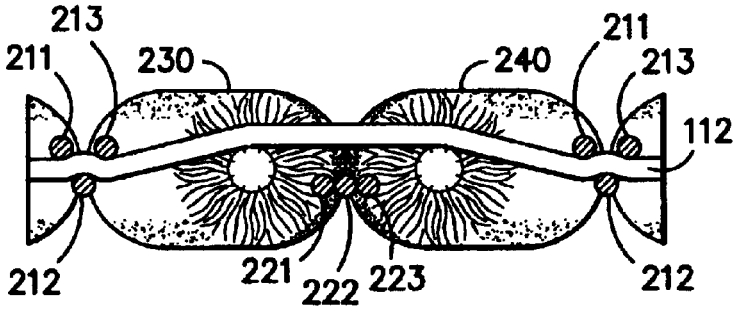
FIG. —4B—
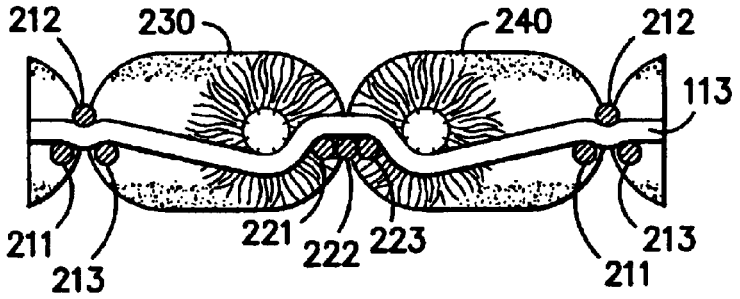
FIG. —4C—
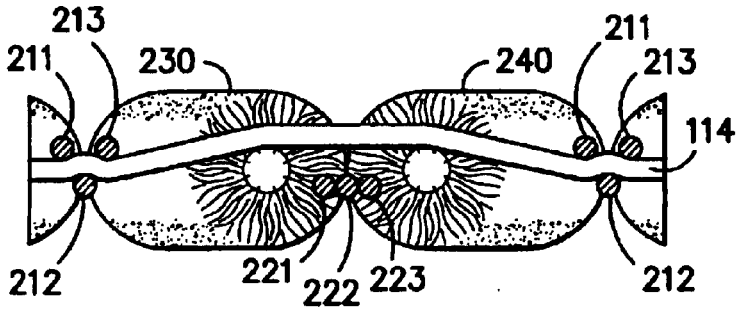
FIG. —4D—

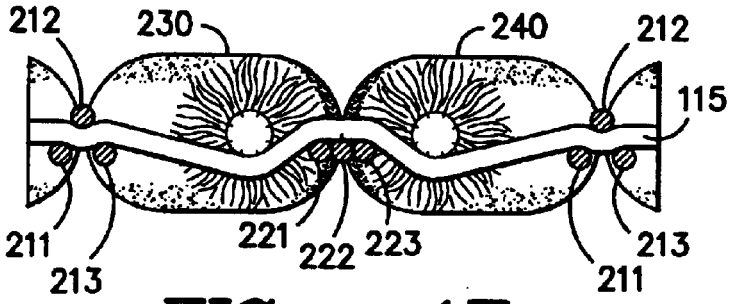
FIG. —4E—
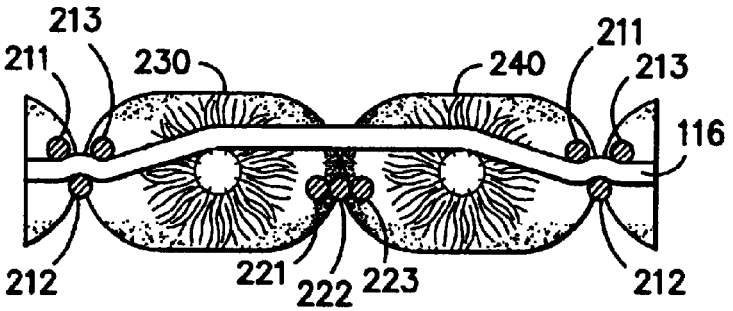
FIG. —4F—
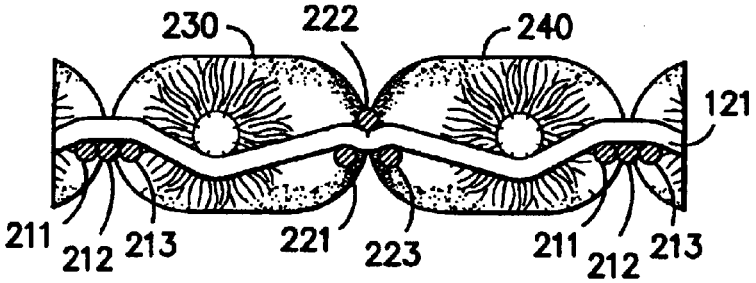
FIG. —4G—
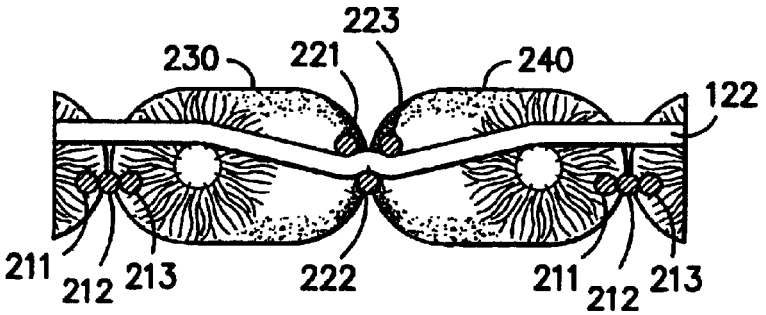
FIG. —4H—

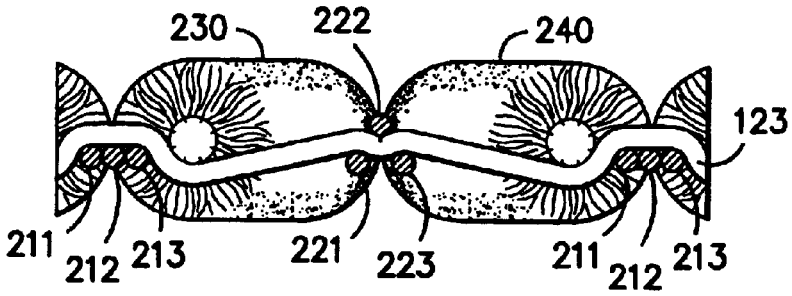
FIG. —4I—
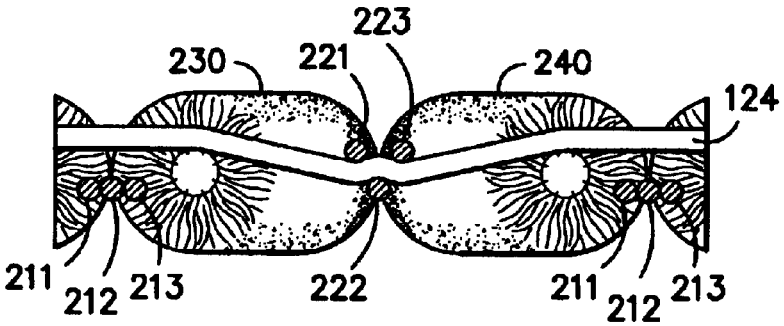
FIG. —4J—
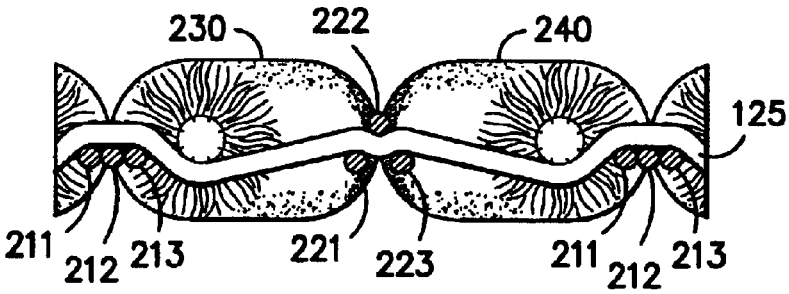
FIG. —4K—
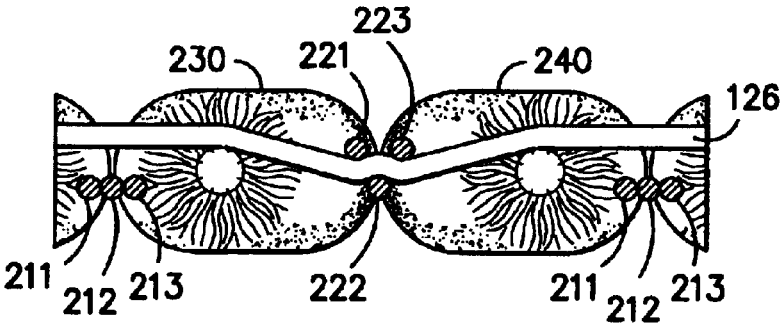
FIG. —4L—

METHOD FOR MAKING A TEXTILE

CROSS REFERENCE TO RELATED APPLICATIONS

This application is a continuation of U.S. patent application Ser. No. 10/365,594 filed Feb. 12, 2003 now U.S. Pat. No. 6,684,911 which is a continuation of previous application Ser. No. 10/050,025, filed on Jan. 15, 2002 now abandoned, which is incorporated in its entirety herein by specific reference thereto.

BACKGROUND

The present invention generally relates to open textiles having a design pattern thereto.

BRIEF DESCRIPTION OF THE DRAWINGS

The present invention can be better understood with reference to the following drawings:

FIGS. 4A–4L are enlarged cross-sections of the textile as illustrated in FIG. 3.

DETAILED DESCRIPTION

Figure 1:
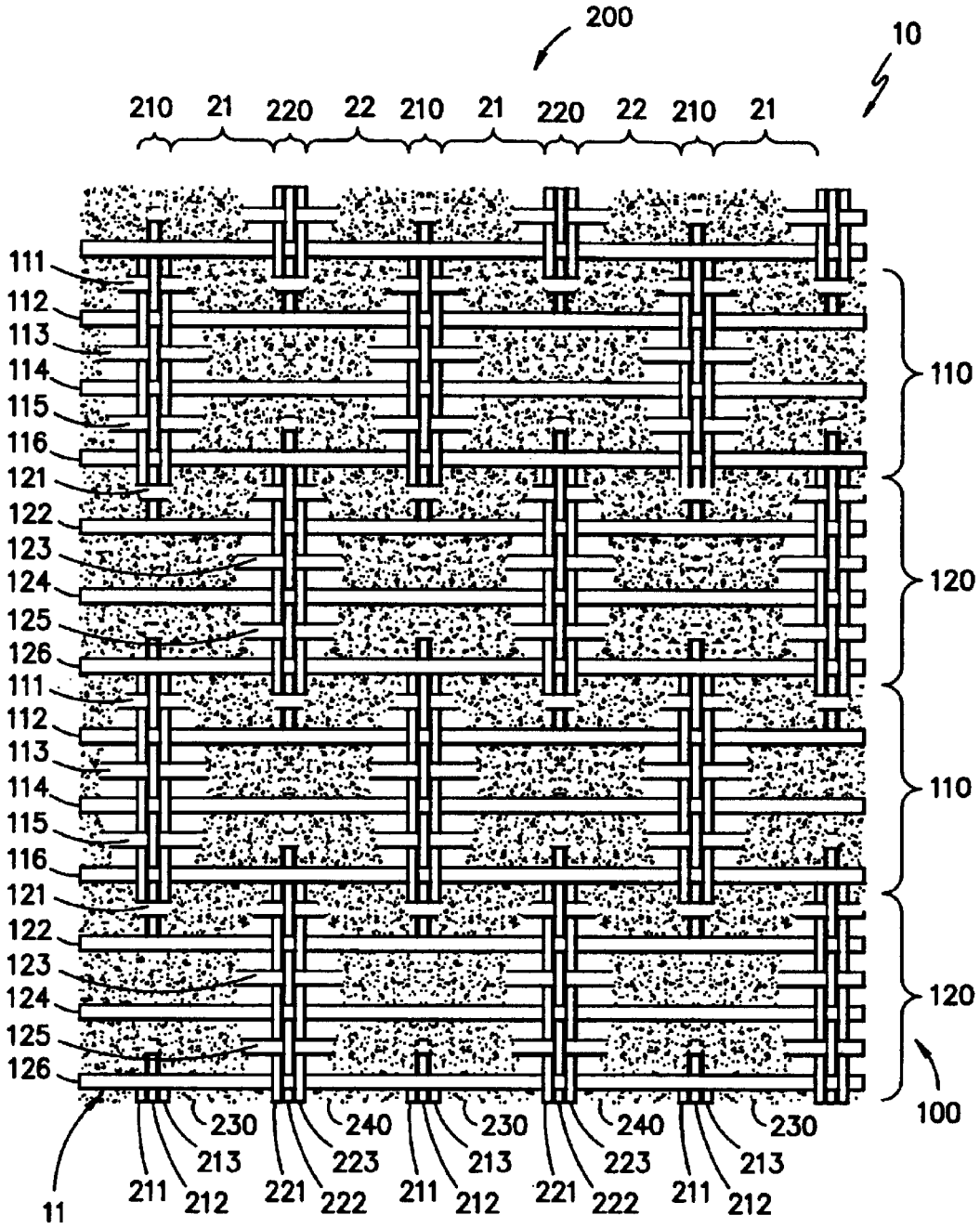
FIG. 1 is an enlarged top plan of a textile incorporating the present invention.
Figure 2:
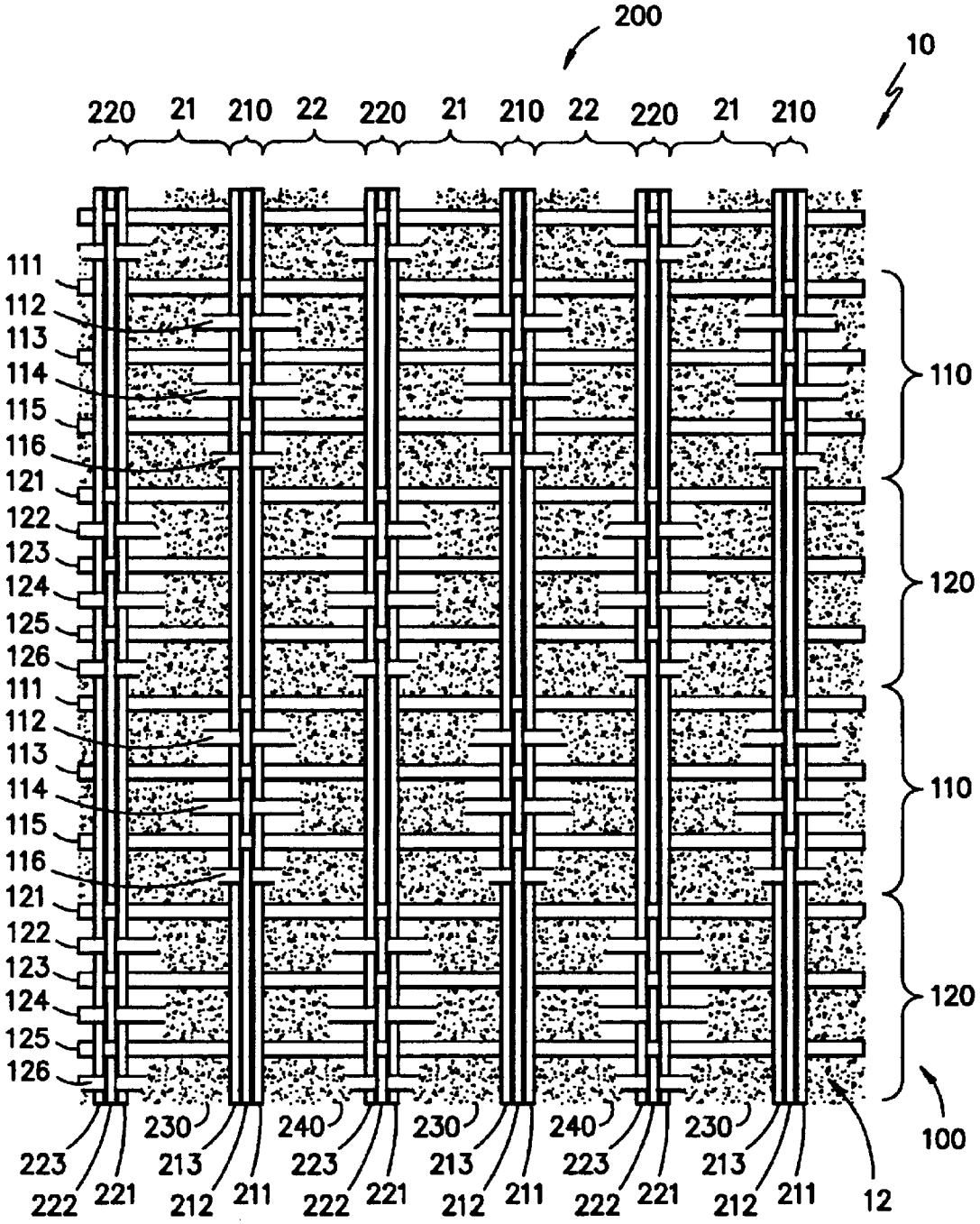
FIG. 2 is an enlarged bottom plan view of the textile from FIG. 1.
Figure 3:
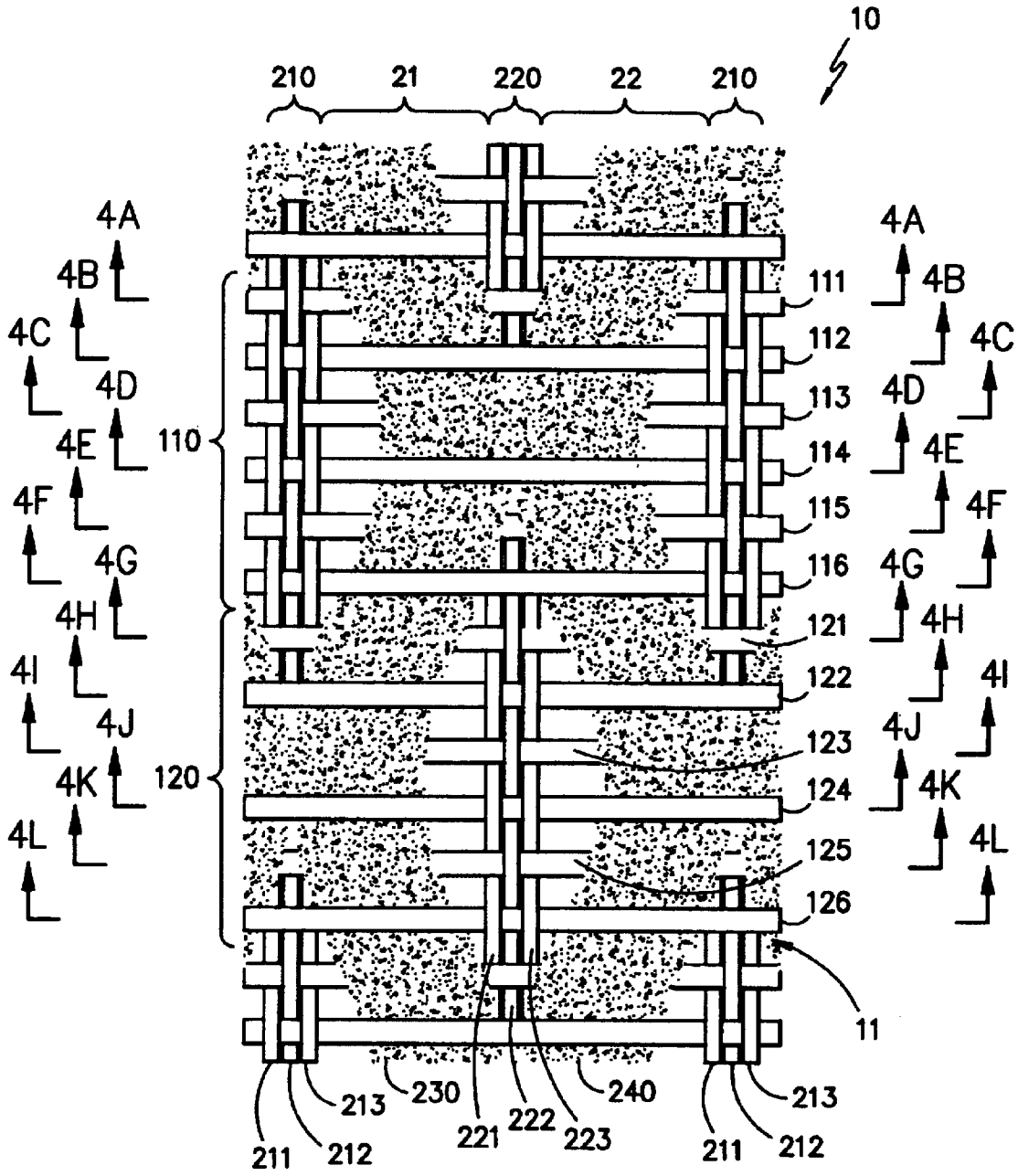
FIG. 3 is an enlarged portion of the textile in FIG. 1.

Referring now to the figures, and in particular to FIGS. 1 and 2, there is shown an embodiment of the present invention illustrated as the textile 10, having a first side 11 and a second side 12. The textile 10 generally comprises a first yarn set 100 interwoven with a second yarn set 200.

The first yarn set 100 includes a plurality of first yarn subsets 110 and a plurality of second yarn subsets 120. The first yarn subsets 110 each include individual first subset yarns 111–116 that are substantially parallel and are disposed at a substantially even spacing. The second yarn subsets 120 each include individual second subset yarns 121–126 that are substantially parallel and are disposed at a substantially even spacing. The first yarn subsets 110 are substantially parallel to, alternatively positioned with the second yarn subsets 120. The spacing of the individual first subset yarns 111–116 and the individual second subset yarns 121–126 are such that the individual first subset yarns 111–116 and the individual second subset yarns 121–126 are substantially even spaced.

The second yarn set 200 includes a plurality of first yarn groupings 210, second yarn groupings 220, first displacement yarns 230, and second displacement yarns 240. The first yarn groupings 210 each include individual first grouping yarns 211–213, that are parallel and substantially in contact along the length of those yarns. The second yarn groupings 220 each include individual second grouping yarns 221–223, that are parallel and substantially in contact along the length of those yarns. The first yarn groupings 210 and the second yarn groupings 220 are positioned substantially parallel to each other, and with a first displacement yarn gap 21 between the first yarn groupings 210 and the second yarn groupings 220, and a second displacement yarn gap 22 between the second yarn groupings 220 and the first yarn groupings 210.

Referring now to FIGS. 1, 2, 3, and 4A–L, the individual first grouping yarns 211–213 and the individual second grouping yarns 221–223 of the second yarn set 200 are oriented substantially perpendicular to the individual first subset yarns 111–116 and the individual second subset yarns 121–126 of the first yarn set 100. The individual first grouping yarns 211–213 of the second yarn set 200 are interwoven with the individual first subset yarns 111–116 of the first yarn set 100, as illustrated in FIGS. 4A–4F. The individual second grouping yarns 220 of the second yarn set 200 are interwoven with the individual second subset yarns 120 of the first yarn set 100, as illustrated in FIGS. 4G–L.

The first displacement yarns 230 are each disposed in one of the first displacement yarn gaps 21 of the second yarn set 200, and are interwoven with the individual first subset yarns 111–116 and the individual second subset yarns 121–126, as illustrated in FIGS. 4A–4L. The second displacement yarns 240 are each disposed in one of the second displacement yarn gaps 22 of the second yarn set 200, and are interwoven with the individual first subset yarns 111–116 and the individual second subset yarns 121–126, as illustrated in FIGS. 4A–4L. The first displacement yarns 230 and the second displacement yarns 240 move sinusoidally back and forth within the first displacement yarn gaps 21 and the second displacement yarn gaps 22, respectively, in opposing sinusoidal patterns, such that each of the first displacement yarns 230 alternately contact the second displacement yarns 240 adjacent thereto along the length of the first displacement yarns 230, and such that each of the second displacement yarns 240 alternatively contact the first displacement yarns 230 adjacent thereto along the length of the second displacement yarns 240.

The overall appearance of the textile 10 is provided by the first and second displacement yarns 230 and 240 giving an alternating diamond shape pattern, and the first yarn groupings 210 and the second yarn groupings 220, providing a leno type appearance through the center of the diamond shape patterns. By using a chenille yarn as the first and second displacement yarns 230 and 240, as illustrated in FIGS. 1 and 2, the textile 10 will have a bulkier and softer feel due to the radial fibers of the chenille yarns. Although the use of chenille yarns as the first and second displacement yarns 230 and 240 will provide the textile 10 with a softer feel, the interweaving of the first and second displacement yarns 230 and 240 with the individual first subset yarns 111–116 and the individual second subset yarns 121–126, will allow the individual first subset yarns 111–116 and the individual second subset yarns 121–126 to provide the textile 10 with an improved abrasion resistance over typical textiles using chenille yarns.

The leno-type appearance created by the first grouping yarns 210 and the second grouping yarns 220, can be enhanced by the use of a lower melt yarn for the individual first grouping yarns 211–213 and the individual second grouping yarns 221–223, and then heat setting the textile 10 so that the individual first grouping yarns 211–213 bond together and the individual second grouping yarns 221–223 bond together. In one embodiment, the individual first grouping yarns 211–213 and/or the individual second grouping yarns 221–223 are a core/sheath yarn, where the sheath has a lower melting point than the core, and where the textile 10 is heat set so that the individual first grouping yarns 211–213 of each first subgrouping 210 bond together and that the individual second grouping yarns 221–223 of each second subgrouping 220 bond together The pattern created by the first displacement yarns 230 and the second displacement yarns 240 can be stabilized by using lower melt yarns for some, or all, of the individual first subset yarns 111–116 and/or the individual second subset yarns 121–126, and then heat setting the textile 10 so that these yarns bond with the first and second displacement yarns 230 and 240. In one embodiment, the individual first subset yarns 111–116 and the individual second subset yarns 121–126 are a core/sheath yarn, where the sheath has a lower melting point than the core, and the textile 10 is heat set so that those yarns bond with the first and second displacement yarns 230 and 240.

The individual first subset yarns 111–116 and the individual second subset yarns 121–126 of the first yarn set 100 can be an elastomeric yarn for suspension purposes, such as in a thin profile type seat. The individual first grouping yarns 211–213 and the individual second grouping yarns 221–223 of the second yarn set 200 can also be an elastomeric yarn for suspension purposes, such as in a thin profile type seat. The term elastomeric yarn, as used herein, means a nontextured yarn that can be stretched at room temperature to at least seventy-five percent over its original length and which after removal of the tensile force will immediately and forcibly return to within ten percent of its original length. To determine if a yarn is elastomeric, ASTM Standard Test Method for Permanent Deformation of Elastomeric Yarns (D 3106-95a), which is incorporated herein in its entirety by specific reference thereto, can be used with the exception that the specimen is stretched to a length of 75% over the original length of the specimen for all stretching time periods, and the elongation after stretch is determined after the longer relaxation time period.

In one embodiment, the individual first subset yarns 111–116 and the individual second subset yarns 121–126 are a 1000 denier monofiliment core/sheath elastomeric yarn, with the sheath being a lower melt temperature than the core, the individual first grouping yarns 211–213 and the individual second grouping yarns 221–223 are a 400 denier monofiliment elastomeric yarn, and the first and second displacement yarns 230 and 240 are a 3150 denier chenille yarn. In this embodiment, the individual first subset yarns 111–116 and the individual second subset yarns 121–126 in of the textile are evenly spaced apart warp yarns during the weaving process, and are at substantially the same tension. Also, the individual first grouping yarns 211–213, the individual second grouping yarns 221–223, and the first and second displacement yarns 230 and 240 are evenly spaced apart weft yarns during the weaving process, and are at substantially the same tension. However, after the weaving process, when tension is removed from the textile 10, the individual first grouping yarns 211–213 come in contact together into the first yarn groups 210, the individual second grouping yarns 221–223 come in contact together to form the second yarn groups 220, and the first and second displacement yarns 230 and 240 move into the sinusoidal pattern illustrated in FIGS. 1 and 2. After the textile 10 is relaxed, the textile 10 can be heated to melt the sheath of the core/sheath elastomeric yarns to bond the yarns.

What is claimed is:

1. A method of making a woven textile, the method comprising:

(a) providing a first set of yarns having a plurality of first yarn subsets and second yarn subsets, said first yarn subsets each including a plurality of individual first subset yarns, said second yarn subsets each including a plurality of second subset yarns;

(b) weaving into said first set of yarns:

(i) a second set of yarns generally perpendicular to said first set of yarns, said second set of yarns having a plurality of first yarn groupings and a plurality of second yarn groupings disposed apart, said first yarn groupings each including a plurality of individual first grouping yarns being in contact as a group and the second yarn groupings each including a plurality of individual second yarn groupings being in contact as a group; and (ii) a plurality of displacement yarns, said displacement yarns running generally perpendicular to said first set of yarns, said displacement yarns being disposed between one of said first yarn groupings and the adjacent one of said second yarn groupings, said displacement yarns further moving sinusoidally between said first yarn groupings and said second yarn groupings such that the displacement yarns alternatively contact said adjacent displacement yarn; and (c) wherein said yarns of said first yarn grouping are interwoven with said yarns of the first yarn subset, and (d) wherein said yarns of said second yarn grouping are interwoven with said yarns of said second yarn subset.

2. The method of making a textile as in claim 1 wherein said individual first yarns subsets and said second yarn subsets are substantially evenly spaced.

3. The method of making a textile as in claim 1 wherein said first grouping yarns are provided in groups that number between two and five.

4. The method of making a textile as in claim 3 wherein said first grouping yarns are provided in groups of three.

5. The method of making a textile as in claim 1 wherein said first yarn groupings and said second yarn groupings are positioned substantially parallel to each other.

6. The method of making a textile as in claim 1 wherein a first displacement yarn gap is positioned between said first yarn groupings and said second yarn groupings.

7. The method of making a textile as in claim 1 wherein said first grouping yarns and said second grouping yarns each are interwoven with said first subset yarns.

8. The method of making a textile as in claim 1 wherein said first grouping yarns and said second grouping yarns are comprised of lower melt yarn.

9. The method of making a textile as in claim 8 wherein said first grouping yarns bond to each other.

10. The method of making a textile as in claim 1 wherein said first and second displacement yarns comprise chenille-type yarns.

11. The method of making a textile as in claim 1 wherein said first grouping yarns and second grouping yarns bond together.

12. The method of making a textile as in claim 1 wherein said textile is heat set.

13. The method of making a textile as in claim 1 further comprising the step of:

(e) bonding said first and second displacement yarns to said first and second subset yarns.

14. The method of making a textile as in claim 1 wherein said first subset yarns and said second subset yarns comprise a 1000 denier monofilament core/sheath type elastomeric yarn.

15. The method of making a textile as in claim 1 wherein said first and second grouping yarns form a sinusoidal pattern.

16. The method of making a textile as in claim 14, further comprising the step of:

(e) melting said core/sheath to form a bond.

17. A method of making a woven textile, the method comprising:

(a) providing a first set of yarns having a plurality of first yarn subsets and second yarn subsets, said first yarn subsets each including a plurality of individual first subset yarns, said second yarn subsets each including a plurality of second subset yarns, wherein said first subset yarns and said second subset yarns comprise monofilament core/sheath type elastomeric yarns;

(b) weaving into said first set of yarns:

(i) a second set of yarns generally perpendicular to said first set of yarns, said second set of yarns having a plurality of first yarn groupings and a plurality of second yarn groupings disposed apart, said first yarn groupings each including a plurality of individual first grouping yarns being in contact as a group and the second yarn groupings each including a plurality of individual second yarn groupings being in contact as a group; and (ii) a plurality of displacement yarns, said displacement yarns running generally perpendicular to said first set of yarns, said displacement yarns being disposed between one of said first yarn groupings and the adjacent one of said second yarn groupings, said displacement yarns further moving sinusoidally between said first yarn groupings and said second yarn groupings such that the displacement yarns alternatively contact said adjacent displacement yarn; and (c) wherein said yarns of said first yarn grouping are interwoven with said yarns of the first yarn subset, and (d) wherein said yarns of said second yarn grouping are interwoven with said yarns of said second yarn subset; and (e) heating said textile, thereby melting said core/sheath elastomeric yarns to form bonds within said woven textile.

* * * * *